US010185284B2

(12) United States Patent
Lin et al.

(10) Patent No.: US 10,185,284 B2
(45) Date of Patent: Jan. 22, 2019

(54) DISASSEMBLABLE IMAGING APPARATUS

(71) Applicant: AVISION INC., Hsinchu (TW)

(72) Inventors: Chia-Hsin Lin, Hsinchu (TW); Jan-Hsing Kao, Miaoli County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/799,024

(22) Filed: Oct. 31, 2017

(65) Prior Publication Data

US 2018/0120761 A1 May 3, 2018

(30) Foreign Application Priority Data

Nov. 2, 2016 (TW) ..... 105216694 U

(51) Int. Cl.
*G03G 15/08* (2006.01)
*G03G 21/16* (2006.01)
*G03G 21/18* (2006.01)

(52) U.S. Cl.
CPC ..... *G03G 21/1647* (2013.01); *G03G 21/1821* (2013.01); *G03G 15/0875* (2013.01); *G03G 2215/066* (2013.01); *G03G 2221/163* (2013.01); *G03G 2221/1606* (2013.01)

(58) Field of Classification Search
CPC ..... G03G 15/0875; G03G 21/1647; G03G 21/1821; G03G 2215/066; G03G 2221/1606; G03G 2221/163
See application file for complete search history.

(56) References Cited

U.S. PATENT DOCUMENTS 4,839,691 A * 6/1989 Tagawa ..... G03G 15/0896 222/DIG. 1
2015/0125180 A1* 5/2015 Mori ..... G03G 21/1821 399/113

* cited by examiner

*Primary Examiner* — Hoang Ngo

(57) ABSTRACT

A disassemblable imaging apparatus includes a photo sensing assembly and a toner cartridge. The photo sensing assembly has an accommodating space, a photosensitive side and a fastening side. The photosensitive side and the fastening side are respectively located at two sides of the accommodating space, which are opposite to each other. The toner cartridge includes a main body and a handle. The handle is swingably connected to a side of the main body in order to move an end of the handle, which is away from the main body, close to or away from the main body. The toner cartridge is detachably installed in the accommodating space, and the handle is detachably fastened to the fastening side of the photo sensing assembly.

10 Claims, 6 Drawing Sheets

DISASSEMBLABLE IMAGING APPARATUS

CROSS-REFERENCE TO RELATED APPLICATIONS

This non-provisional application claims priority under 35 U.S.C. § 119(a) on Patent Application No(s). 105216694 filed in Taiwan, R.O.C. on Nov. 2, 2016, the entire contents of which are hereby incorporated by reference.

TECHNICAL FIELD

The disclosure relates to an imaging apparatus, more particularly to a disassemblable imaging apparatus.

BACKGROUND

The conventional printer is generally divided into the laser printer and the light emitting diode (LED) printer according to the difference of their light source. In comparison, the LED light source has a longer service life and lower power consumption. In addition, heat generated by the LED light source is relatively low so that the requirements of the heat dissipation component can be reduced, thereby reducing noise while the printer is in operation. Moreover, the LED printer has no need to be equipped with a complicated optical structure, so the LED printer has high durability and reliability, the size of the LED printer can be smaller than the size of the laser printer, and the LED printer can be designed to have more functions than the functions which the laser printer has. Therefore, the LED printer has become the mainstream product.

In detail, an imaging apparatus of a conventional printer includes a photosensitive drum and a toner cartridge. Generally, the traditional photosensitive drum and the traditional toner cartridge are inseparable. However, in such a design, with the raise of environmental awareness, some of printer manufacturers start to design the toner cartridge, which is consumable, to be changeable, and let the photosensitive drum, which is not consumable, can be used repeatedly. As a result, the photosensitive drum and the toner cartridge are designed to be separable; to make the imaging apparatus becomes disassemblable.

However, in the conventional disassemblable imaging apparatus, it is inconvenient for user to assemble and disassemble the photosensitive drum and the toner cartridge. Accordingly, how to conveniently assemble and disassemble the photosensitive drum and the toner cartridge, and how to improve the reliability of the disassemblable imaging apparatus become a main topic to the developers.

SUMMARY

One embodiment of the disclosure provides a disassemblable imaging apparatus including a photo sensing assembly and a toner cartridge. The photo sensing assembly has an accommodating space, a photosensitive side and a fastening side. The photosensitive side and the fastening side are respectively located at two sides of the accommodating space, which are opposite to each other. The toner cartridge includes a main body and a handle. The handle is swingably connected to a side of the main body in order to move an end of the handle, which is away from the main body, close to or away from the main body. The toner cartridge is detachably installed in the accommodating space, and the handle is detachably fastened to the fastening side of the photo sensing assembly.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
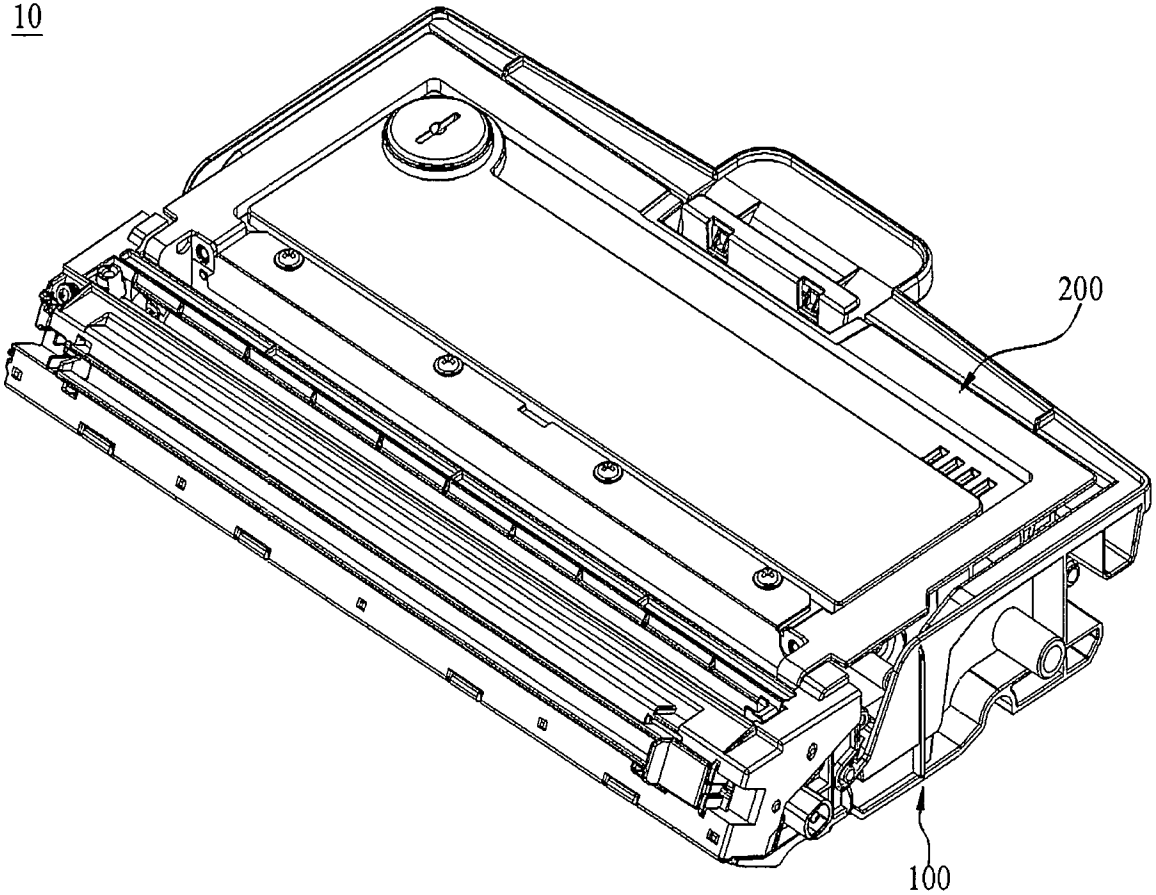
FIG. 1 is a perspective view of a disassemblable imaging apparatus according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
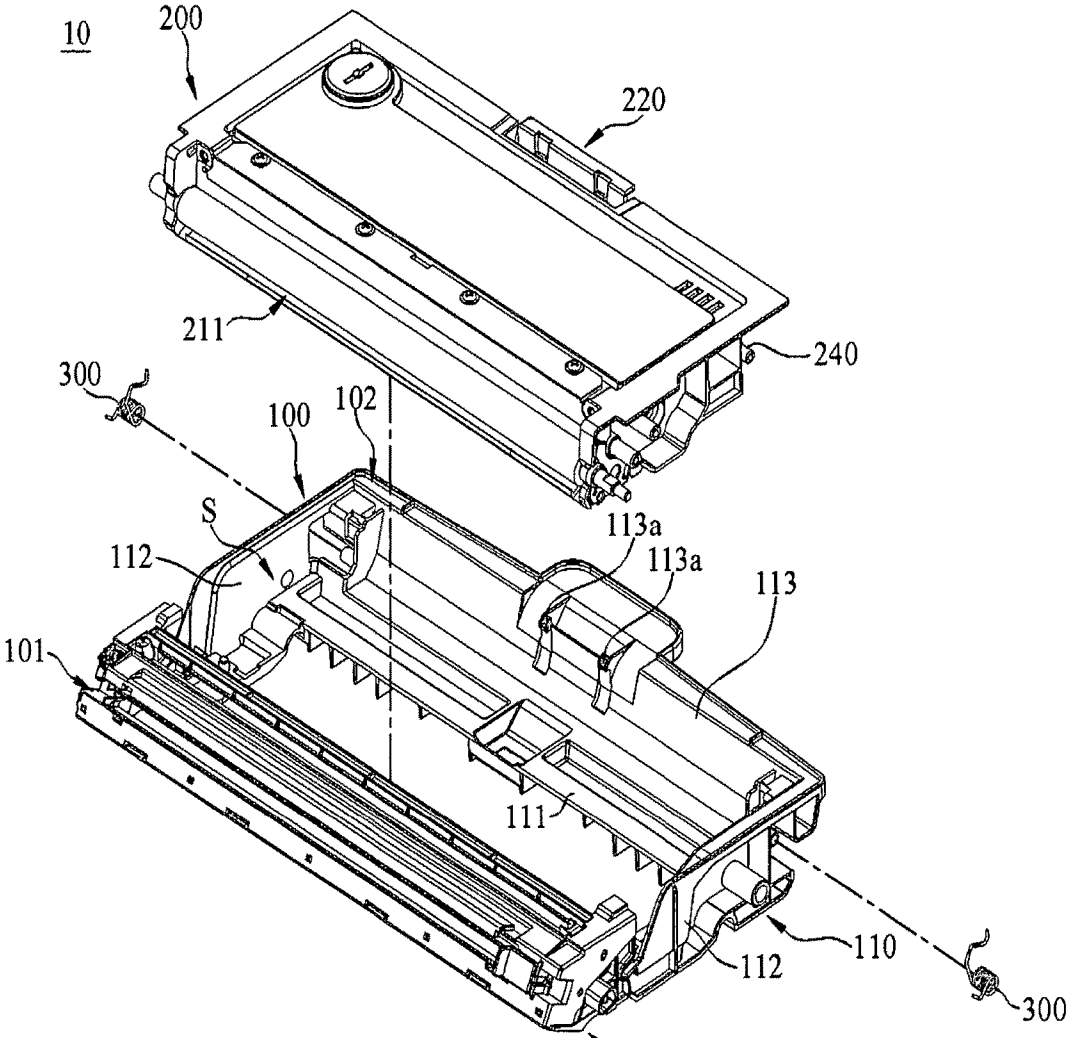
FIG. 2 to FIG. 3 are exploded views of the disassemblable imaging apparatus in FIG. 1.
Figure 3:
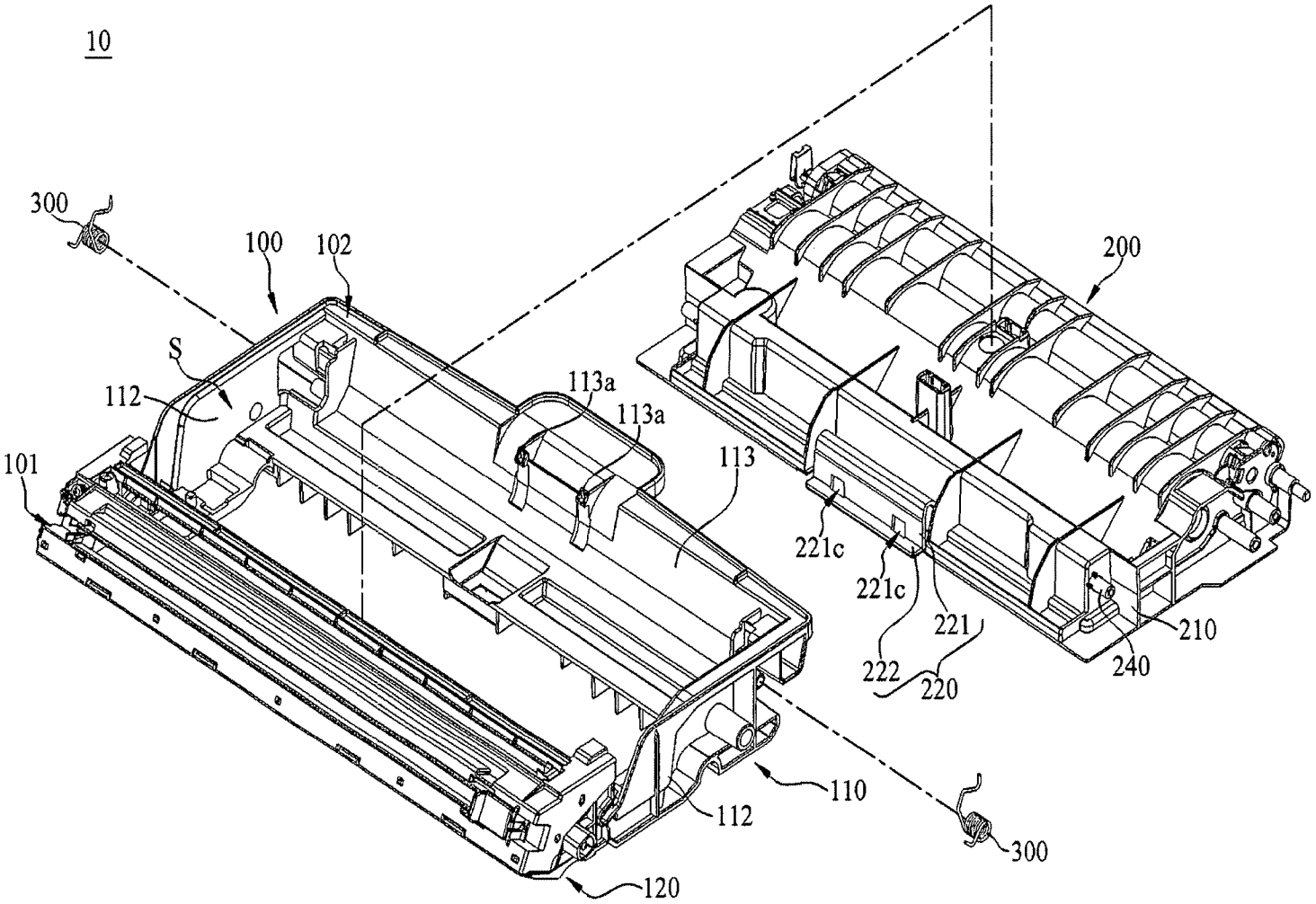

Please refer to FIGS. 1 to 3. FIG. 1 is a perspective view of a disassemblable imaging apparatus according to an embodiment of the disclosure, and FIG. 2 to FIG. 3 are exploded views of the disassemblable imaging apparatus in FIG. 1.

In this embodiment, a disassemblable imaging apparatus 10 is provided. The disassemblable imaging apparatus 10 includes a photo sensing assembly 100 and a toner cartridge 200. The photo sensing assembly 100 has an accommodating space S, a photosensitive side 101 and a fastening side 102. The photosensitive side 101 and the fastening side 102 are respectively located at two sides of the accommodating space S which are opposite to each other. In detail, the photo sensing assembly 100 includes a casing 110 and a photosensitive drum 120. The casing 110 includes a base board 111, two side boards 112 and a back board 113. The two side boards 112 are respectively connected to two sides of the base board 111 which are opposite to each other. The two side boards 112 are connected to each other by the back board 113. The two side boards 112 and the back board 113 together form the accommodating space S. The photosensitive drum 120 is installed on a side of the base board 111 away from the back board 113. That is, the photosensitive drum 120 is located at the photosensitive side 101 of the photo sensing assembly 100, and the back board 113 is located at the fastening side 102 of the photo sensing assembly 100.

The toner cartridge 200 is detachably located in the accommodating space S. The toner cartridge 200 is located between the photosensitive drum 120 and the back board 113. The toner cartridge 200 includes a main body 210 and a handle 220. An internal space of the main body 210 is configured to store toner. The main body 210 has a toner outlet 211 aligned with the photosensitive drum 120 in order to transfer toner to paper through the photosensitive drum 120.

In this embodiment, the handle 220 is connected to a central portion of a side of the main body 210, for users to easily carry the toner cartridge 200, but the present disclosure is not limited thereto. In some embodiments, the handle 220 is connected to a portion of the side of the main body 210 aside from the central portion.

In this embodiment, the handle 220 has an engaging side 220*a* and a fixed side 220*b* which are opposite to each other, the handle 220 is connected to a side of the main body 210 via the fixed side 220*b*, the handle 220 is elastic so that the engaging side 220*a* is swingably with respect to the main body 210 so as to be movable close to or away from the fixed side 210 and therefore the engaging side 220*a* is detachably fastened to the fastening side 102 of the photo sensing assembly 100.

In detail, the handle 220 includes an elastic arm 221 and a hold portion 222. The engaging side 220*a* is on the hold portion 222, and the fixed side 220*b* is on the elastic arm 221. The main body 210 and the hold portion 222 are connected to each other by the fixed side 220*b* on the elastic arm 221 so that the hold portion 222 is swingable with respect to the main body 210. The elastic arm 221 has a first surface 221*a* and a second surface 221*b* which are opposite to each other. The first surface 221*a* faces the main body 210, and the first surface 221*a* and the main body 210 form a space 230 therebetween. The second surface 221*b* face away from the photosensitive side 101 of the photo sensing assembly 100, and the hold portion 222 protrudes from the second surface 221*b* of the elastic arm 221. In addition, the elastic arm 221 has a first fastener 221*c*. The first fastener 221*c* is, for example, a through hole, and the first fastener 221*c* extents from the first surface 221*a* to the second surface 221*b*. A side of the back board 113 close to the photosensitive drum 120 has a second fastener 113*a*. The second fastener 113*a* is, for example, a protrusion, and the first fastener 221*c* is detachably fastened to the second fastener 113*a*. Therefore, the handle 220 is able to be fastened to the back board 113 of the casing 110, so that the toner cartridge 200 is fixed in place in the accommodating space S.

In addition, the second fastener 113*a* has an inclined surface 113*b*. The inclined surface 113*b* is configured for the first fastener 221*c* to be smoothly fastened to the second fastener 113*a*.

However, the present disclosure is not limited to the configurations of the first fastener 221*c* and the second fastener 113*a*. In some embodiments, the first fastener is a protrusion, and the second fastener is a through hole.

In this and some embodiments, the disassemblable imaging apparatus 10 further includes two torsion springs 300. The toner cartridge 200 further includes two press protrusion 240 which are opposite to each other. Due to the point of views of the figures, only one of the press protrusion 240 is illustrated. The press protrusion 240 protrudes from the main body 210. A section of the torsion spring 300 is installed on the casing 110, and the opposite section of the torsion spring 300 presses against a side of the press protrusion 240, which faces away from the photosensitive drum 120, so that the toner outlet 211 is located close to the photosensitive drum 120, thereby improving the imaging quality of the disassemblable imaging apparatus 10.

Figure 4:
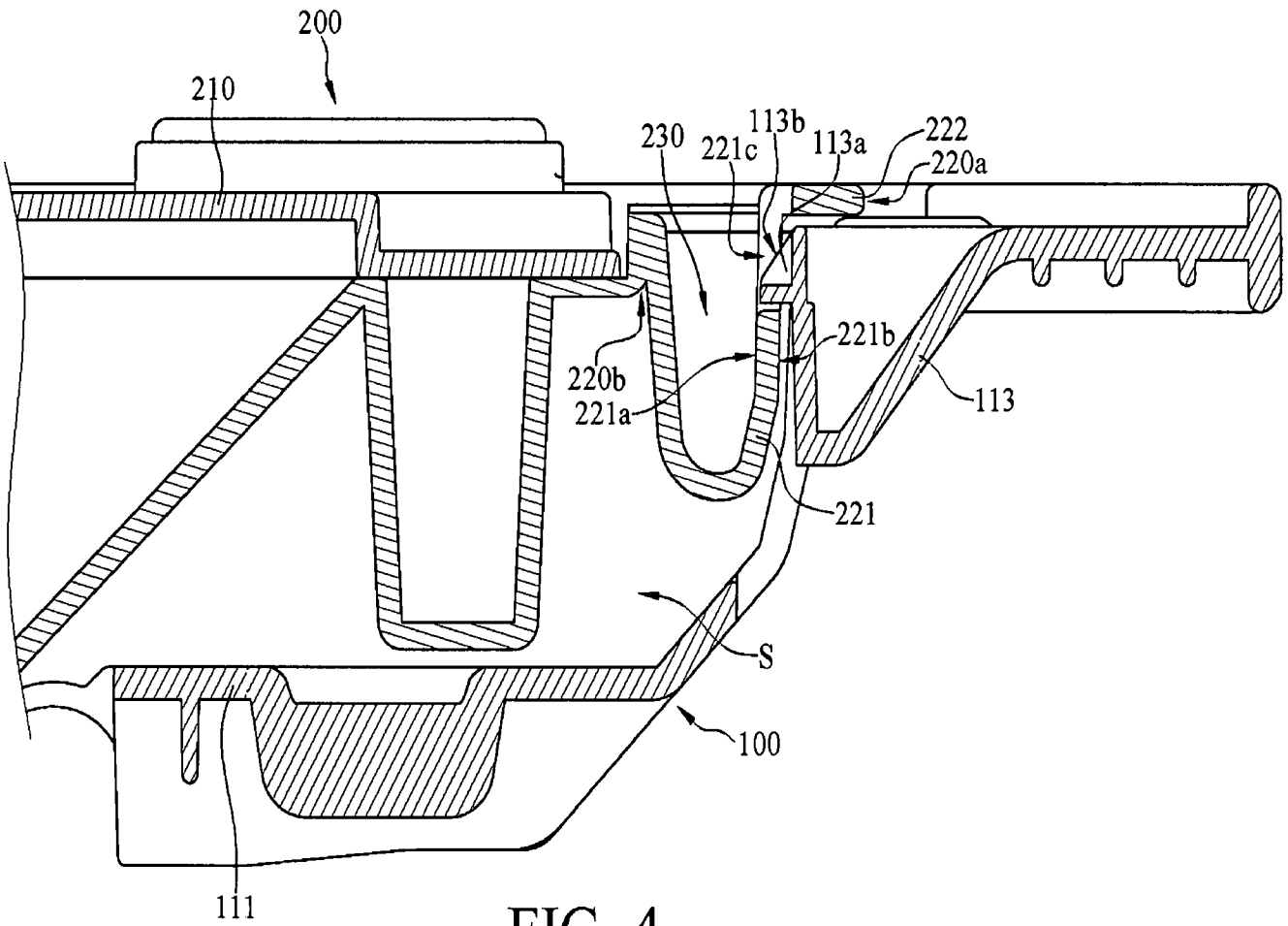
FIG. 4 to FIG. 6 show disassembling processes of the disassemblable imaging apparatus in FIG. 1.
Figure 5:
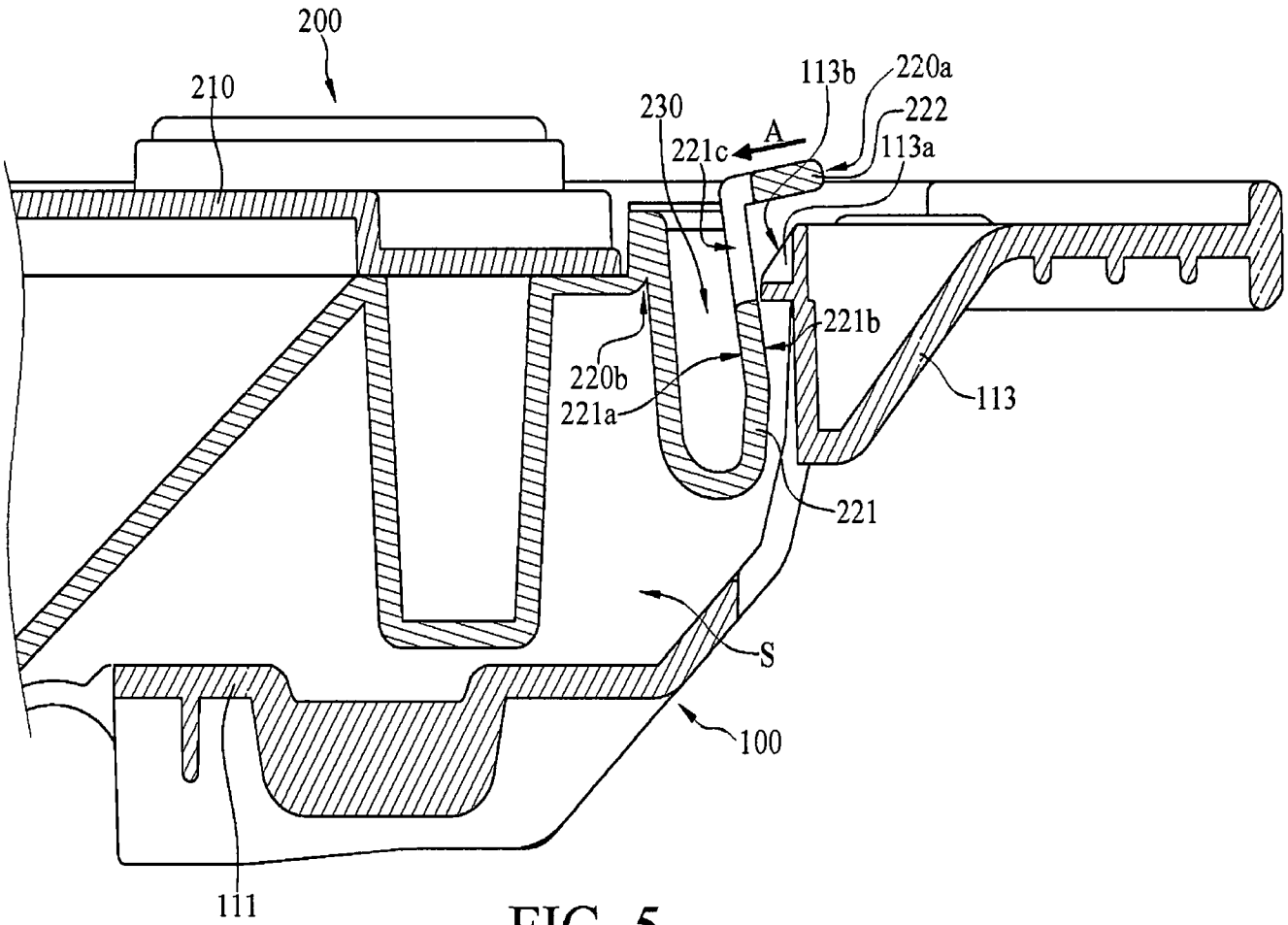
Figure 6:
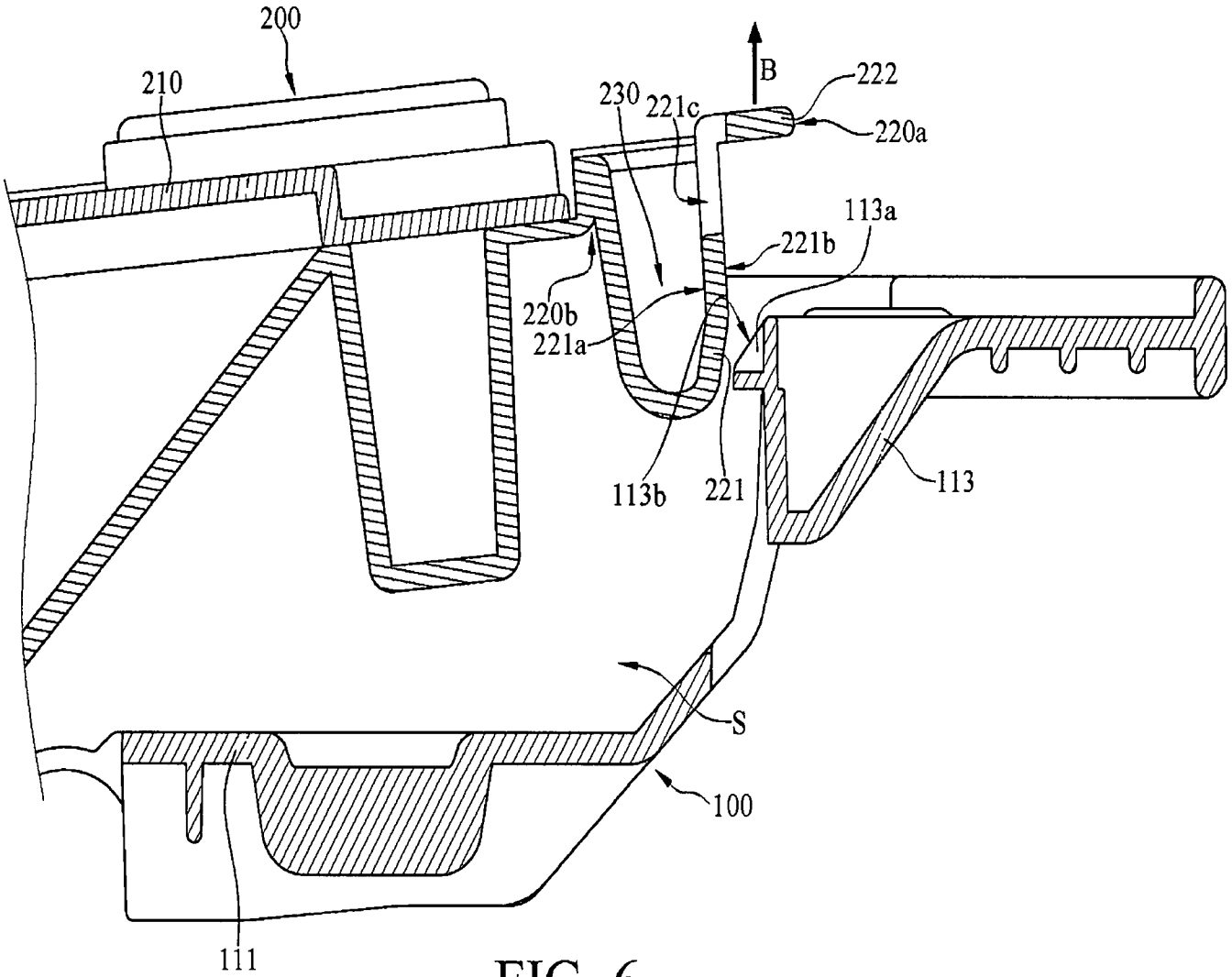

Please refer to FIGS. 4 to 6. FIG. 4 to FIG. 6 show the disassembling processes of the disassemblable imaging apparatus in FIG. 1.

As shown in FIG. 4, the toner cartridge 200 is installed in the accommodating space S of the photo sensing assembly 100, and the first fastener 221*c* of the elastic arm 221 is fastened to the second fastener 113*a* of the back board 113. Therefore, the toner cartridge 200 is fixed in place in the accommodating space S of the photo sensing assembly 100.

Then, as shown in FIG. 5, when the user uses, for example, his/her finger to move the hold portion 222 in a direction of arrow A, the hold portion 222 forces the elastic arm 221 to move in the direction of arrow A. Therefore, the first fastener 221*c* of the elastic arm 221 is detached from the second fastener 113*a* of the back board 113.

Then, as shown in FIG. 6, the user keeps the first fastener 221*c* of the elastic arm 221 to be detached from the second fastener 113*a* of the back board 113, and further lifts a side of the toner cartridge 200, which is away from the photosensitive drum 120, in a direction of arrow B in succession. Therefore, the toner cartridge 200 is removed from the photo sensing assembly 100.

In the aforementioned disassembling processes, the first fastener 221*c* is fastened to the handle, so that the detaching and the removal of the toner cartridge 200 can be finished by one hand with one fluid movement. Thus, it is convenient for user to assemble and disassemble the photo sensing assembly 100 and the toner cartridge 200.

In addition, the handle is swingably connected to the main body, so the handle is able to be firmly fastened to the fastening side of the photo sensing assembly by the elastic force of the handle, and the assembly of the photo sensing assembly and the toner cartridge has good reliability.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A disassemblable imaging apparatus, comprising:

a photo sensing assembly, having an accommodating space, a photosensitive side and a fastening side, and the photosensitive side and the fastening side being respectively located at two sides of the accommodating space which are opposite to each other; and a toner cartridge, being detachably installed in the accommodating space and comprising a main body and a handle, wherein two opposite sides of the handle respectively are an engaging, side and a fixed side, the handle is connected to a side of the main body via the fixed side, the handle is elastic so that the engaging side is swingably with respect to the main body so as to be movable close to or away from the fixed side to be detachably fastened to the fastening side of the photo sensing assembly.

2. The disassemblable imaging apparatus according to claim 1, wherein the photo sensing assembly comprises a casing and a photosensitive drum, the casing comprises a base board, two side boards and a back board, the two side boards are respectively connected to two sides of the base board, which are opposite to each other, the two side boards are connected to each other by the back board, the two side boards and the back board form the accommodating space, the photosensitive drum is installed at a side of the base board away from the back board, and the handle is fastened to the back board of the casing.

3. The disassemblable imaging apparatus according to claim 2, wherein the handle comprises an elastic arm and a hold portion, the main body and the hold portion are connected to each other by the elastic arm, and the hold portion is swingable with respect to the main body, the elastic arm has a first fastener, the back board of the casing has a second fastener, the first fastener is detachably fastened to the second fastener.

4. The disassemblable imaging apparatus according to claim 3, wherein the first fastener is a through hole, the second fastener is a protrusion with an inclined surface, and the inclined surface faces away from the base board.

5. The disassemblable imaging apparatus according to claim 2, further comprising at least one torsion spring, the toner cartridge further comprising a press protrusion, the press protrusion protruding from the main body, a section of the torsion spring being installed on the casing, and the opposite section of the torsion spring pressing against a side of the press protrusion facing away from the photosensitive drum.

6. The disassemblable imaging apparatus according to claim 1, wherein the handle comprises an elastic arm and a hold portion, the main body and the hold portion are connected to each other by the elastic arm, and the hold portion is swingable with respect to the main body, the elastic arm has a first fastener, the fastening side of the photo sensing assembly has a second fastener, the first fastener is detachably fastened to the second fastener.

7. The disassemblable imaging apparatus according to claim 6, wherein the elastic arm has a first surface and a second surface, which are opposite to each other, the first surface faces the main body, the first surface and the main body form a space therebetween, the second surface faces away from the photosensitive side of the photo sensing assembly, and the hold portion protrudes from the second surface of the elastic arm.

8. The disassemblable imaging apparatus according to claim 6, wherein the first fastener is a through hole, and the second fastener is a protrusion.

9. The disassemblable imaging apparatus according to claim 6, wherein the first fastener is a protrusion, and the second fastener is a through hole.

10. The disassemblable imaging apparatus according to claim 1, wherein the handle is located at a central portion of a side of the main body.

* * * * *